US007602235B2

(12) United States Patent
Tsuchihashi et al.

(10) Patent No.: US 7,602,235 B2
(45) Date of Patent: Oct. 13, 2009

(54) SEMICONDUCTOR DEVICE WITH INTERNAL CURRENT GENERATING SECTION

(75) Inventors: Masanori Tsuchihashi, Kyoto (JP); Shigeru Hirata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 3 days.

(21) Appl. No.: 11/813,359

(22) PCT Filed: Oct. 21, 2005

(86) PCT No.: PCT/JP2005/019374

§ 371 (c)(1),
(2), (4) Date: Jul. 5, 2007

(87) PCT Pub. No.: WO2006/075425

PCT Pub. Date: Jul. 20, 2006

(65) Prior Publication Data

US 2008/0111614 A1 May 15, 2008

(30) Foreign Application Priority Data

Jan. 17, 2005 (JP) ..... 2005-009232

(51) Int. Cl.
*G05F 1/10* (2006.01)

(52) U.S. Cl. ..... 327/538; 323/316

(58) Field of Classification Search ..... 327/538, 327/540–543; 323/315, 316
See application file for complete search history.

(56) References Cited

U.S. PATENT DOCUMENTS 4,246,517 A * 1/1981 Dakroub ..... 315/307
4,710,730 A * 12/1987 Doyle, III ..... 331/116 FE
5,764,107 A * 6/1998 Stone ..... 330/279
5,804,956 A * 9/1998 Pulvirenti ..... 323/277
5,999,041 A 12/1999 Nagata et al.
6,137,273 A * 10/2000 Bales et al. ..... 323/269
6,343,024 B1 * 1/2002 Zabroda ..... 363/22
6,940,338 B2 * 9/2005 Kizaki et al. ..... 327/543
7,368,959 B1 * 5/2008 Xu et al. ..... 327/141
7,405,547 B2 * 7/2008 Kanzaki ..... 323/277
2003/0107429 A1 * 6/2003 Kawano ..... 327/538
2006/0181257 A1 * 8/2006 Veenstra et al. ..... 323/315

FOREIGN PATENT DOCUMENTS

JP 06-180806 6/1994
JP 10-032475 2/1998
JP 2002-304225 10/2002
JP 2004-227102 8/2004

* cited by examiner

*Primary Examiner*—Lincoln Donovan
*Assistant Examiner*—Thomas J Hiltunen
(74) *Attorney, Agent, or Firm*—Fish & Richardson P.C.

(57) ABSTRACT

A semiconductor device comprising an internal current generating section (1) for supplying an output current (i2) dependent on an input current (i1) into an IC, an external terminal (2) for connecting an external resistor (Rex) to the input end side of the internal current generating section (1), a current limiting element (3) connoted between the input end of the internal current generating section (1) and the external terminal (2), a first current limiting section (4) for pulling in the input current (i1) when one end voltage VA of the current limiting element (3) is higher than a first threshold voltage VB, and a second current limiting section (5) for pulling in the input current (i1) when the terminal voltage VC of the external terminal (2) is higher than a second threshold voltage. System down can be avoided by operating the internal circuit surely regardless of the state of the external terminal.

19 Claims, 3 Drawing Sheets

SEMICONDUCTOR DEVICE WITH INTERNAL CURRENT GENERATING SECTION

TECHNICAL FIELD

The present invention relates to a semiconductor device that permits an internal current to be set freely by appropriate selection of an external resistor.

BACKGROUND ART

There have conventionally been disclosed and proposed semiconductor devices that have, on an input node side of a current mirror circuit, an external terminal to which to connect an external resistor for setting an internal current in order to permit the internal current to be set freely through appropriate selection of the external resistor by a user (see, for example, Patent Document 1 listed below).

As shown in FIG. 4(*a*), in some conventional semiconductor devices, an internal resistor RL is inserted between an input node of a current mirror circuit and an external terminal Tex to serve as current limiting means in case the external terminal Tex short-circuits to ground (not necessarily to ground itself but to any comparable low-voltage part; this applies throughout the present specification).

As shown in FIG. 4(*b*), in some other conventional semiconductor devices, a constant current source is provided that derives a predetermined bias current ibias (i.e., the minimum set level of an internal current i) from an input node of a current mirror circuit to serve as current limiting means not only in case an external terminal Tex short-circuits to ground but also in case the external terminal Tex short-circuits to a supply voltage (not necessarily to a Vcc itself but to any comparable high-voltage part; this applies throughout the present specification) and in case the external terminal Tex is left open.

Patent Document 1: JP-A-H6-180806

DISCLOSURE OF THE INVENTION

Problems to be Solved by the Invention

To be sure, with the conventional configuration shown in FIG. 4(*a*), even if the external terminal Tex short-circuits to ground, the internal current i can be limited below or equal to a maximum level. However, with this conventional configuration, if the external terminal Tex short-circuits to a supply voltage, or if it is left open, the internal current i cannot be limited above or equal to a minimum level. Thus, in the worst case, the internal circuit may become unable to operate, resulting in system breakdown.

On the other hand, with the conventional configuration shown in FIG. 4(*b*), it is certainly possible to limit the internal current i below or equal to a maximum level if the external terminal Tex short-circuits to ground, and to limit the internal current i above or equal to a minimum level if the external terminal Tex short-circuits to a supply voltage or if it is left open. However, with this conventional configuration, irrespective of the status of the external terminal Tex, the constant bias current ibias is derived all the time. Thus, even when the terminal voltage at the external terminal Tex is fixed at a predetermined level, the simple equation "(Internal Current i)=(Terminal Voltage at External Terminal Tex)/(Resistance of External Resistor Rex) no longer holds. This makes it difficult to calculate the resistance of the external resistor Rex, resulting in poor usability.

An object of the present invention is to provide a semiconductor device that allows its internal circuit to operate steadily irrespective of the state of an external terminal and that can thereby prevent system breakdown.

Means for Solving the Problem

To achieve the above object, according to the present invention, a semiconductor device provided with an internal current generating section that generates an output current according to an input current flowing at the input node thereof and that feeds the output current to an internal circuit and an external terminal via which an external resistor for setting the internal current is connected to the input-node side of the internal current generating section is further provided with: a current limiting element that is connected between the input node of the internal current generating section and the external terminal; and one of a first current limiting section that derives the input current when the voltage at a first end of the current limiting element is higher than a first threshold voltage and a second current limiting section that derives the input current when the terminal voltage at the external terminal is higher than a second threshold voltage. (A first configuration.) With this configuration, it is possible, irrespective of the state of the external terminal, to make the internal circuit operate steadily and thereby prevent system breakdown.

In the semiconductor device of the first configuration described above, preferably, the first current limiting section is provided with: a differential amplifier circuit that receives, as differential inputs thereto, the voltage at the first end of the current limiting element and the first threshold voltage; and a first current mirror circuit that, according to the output current of the differential amplifier circuit that flows at the input node of the first current mirror circuit, derives the input current from the first end of the current limiting element. (A second configuration.) With this configuration, it is possible to realize the first current limiting section with a simple configuration.

In the semiconductor device of the first configuration described above, preferably, the second current limiting section is provided with: a second current mirror circuit that, according to the current that flows at the input node thereof, derives the input current from the first end of the current limiting element; and a switch circuit that is connected between the external terminal and the input node of the second current mirror circuit and that conducts when the terminal voltage at the external terminal is higher than a second threshold voltage. (A third configuration.) With this configuration, it is possible to realize the second current limiting section with a simple configuration.

In the semiconductor device of the second configuration described above, preferably, the switch circuit is provided with: a resistor of which one end is connected to the external terminal; and a diode or diode array of which the anode end is connected to the resistor and of which the cathode end is connected to the input node of the second current mirror circuit. (A fourth configuration.) With this configuration, it is possible to realize the switch circuit with a simple configuration.

Alternatively, in the semiconductor device of the first configuration described above, preferably, the second current limiting section is provided with: a direct-current voltage source that generates the second threshold voltage; a comparator that shifts the output logic level thereof according to the levels of the terminal voltage at the external terminal and the second threshold voltage relative to each other; and a transistor that derives the input current from the first end of the current limiting element when the terminal voltage at the external terminal is higher than the second threshold voltage according to the output signal of the comparator. (A fifth configuration). With this configuration, the second threshold voltage is generated by a direct-current voltage source (e.g., a band-gap power supply circuit) whose characteristics do not depend on temperature. Thus, it is possible to avoid the influence of temperature-related characteristics of the relevant element as experienced in the above-mentioned configuration using a diode or diode array.

In the semiconductor device of the first configuration described above, preferably, a bias section is additionally provided that applies a predetermined bias voltage to the external terminal. (A sixth configuration.) With this configuration, where the terminal voltage at the external terminal is previously determined with the bias section, the user of the semiconductor device can very easily calculate the resistance of the external resistor he should select to obtain the desired internal current. This helps improve the usability of the semiconductor device.

In the semiconductor device of the sixth configuration described above, preferably, the bias section is formed with an npn-type bipolar transistor whose collector is connected to the first end of the current limiting element and whose emitter is connected to the external terminal. (A seventh configuration.) With this configuration, it is possible to realize the bias section with a simple configuration.

In the semiconductor device of the first configuration described above, preferably, the current limiting element is a direct-current impedance element. (An eighth configuration.)

In the semiconductor device of the first configuration described above, preferably, the internal current generator is a current mirror circuit formed with a pair of transistors. (A ninth configuration.) With this configuration, it is possible to realize the internal current generator with a simple configuration.

Advantages of the Invention

As described above, with semiconductor devices according to the present invention, it is possible, irrespective of the state of an external terminal, to make an internal circuit operate steadily and thereby prevent system breakdown.

LIST OF REFERENCE SYMBOLS

1 Internal Current Generator
2 External Terminal
3 Current Limiting Element
4 First Current Limiting Section
5 Second Current Limiting Section
6 Bias Section
P1-P4 pnp-type Bipolar Transistors
N1-N7 npn-type Bipolar Transistors
Rex External Resistor
RL1-RL3 Internal Resistors
D1-D3 Diodes
I1-I2 Constant Current Sources
L1 Power Line
CMP Comparator
E1 Direct-current Voltage Source

BEST MODE FOR CARRYING OUT THE INVENTION

Figure 1:
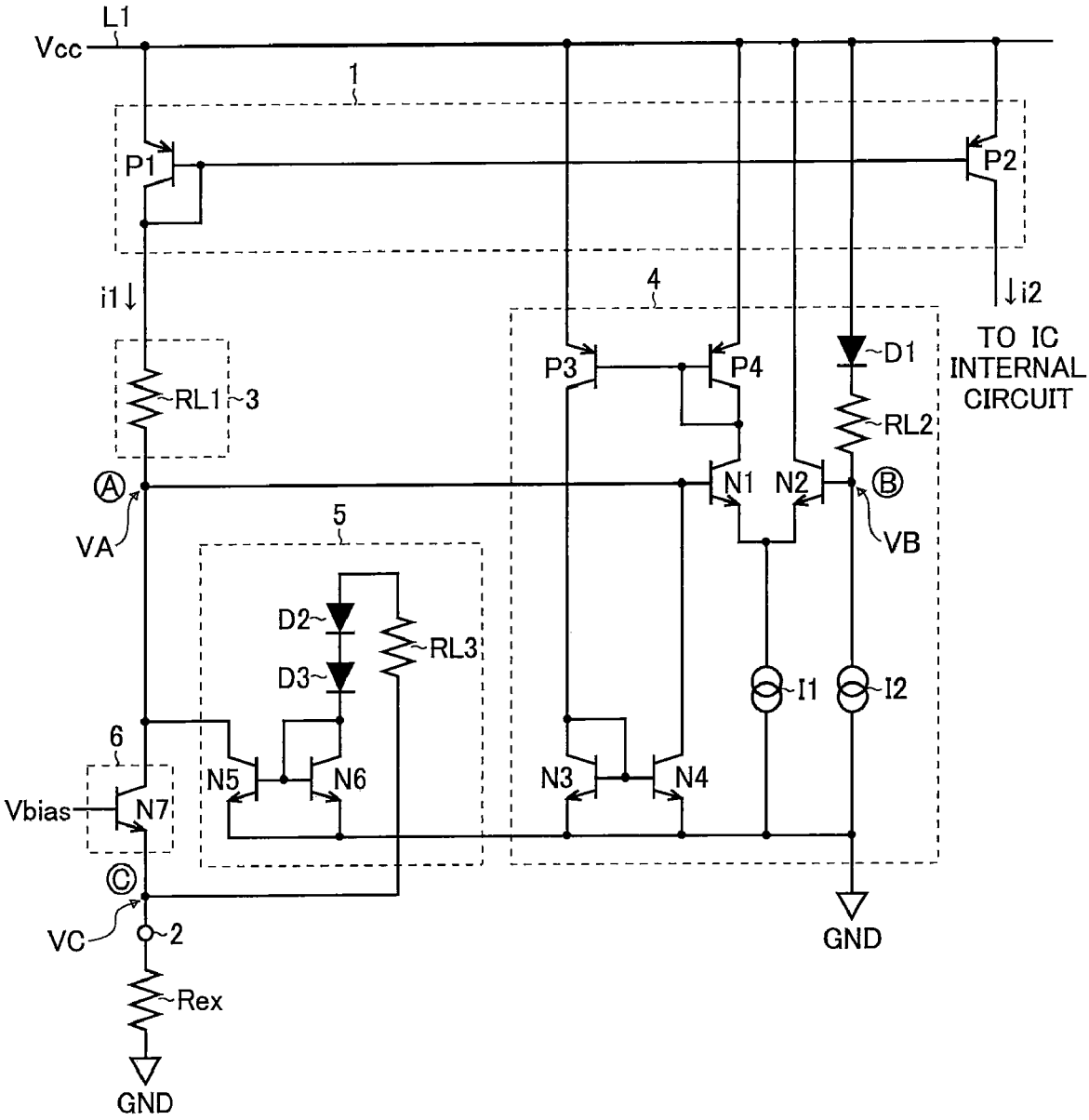
[FIG. 1] A circuit diagram showing a semiconductor device according to the invention.

FIG. 1 is a circuit diagram showing a semiconductor device according to the invention, and shows, in particular, its part around a circuit section that generates an internal current to be used within the semiconductor device. As shown in the figure, the semiconductor device of this embodiment includes an internal current generator 1, an external terminal 2, a current limiting element 3, a first current limiting section 4, a second current limiting section 5, and a bias section 6.

The internal current generator 1 includes pnp-type bipolar transistors P1 and P2. The emitters of the transistors P1 and P2 are both connected to a power line L1, and the bases of the transistors P1 and P2 are both connected to the collector of the transistor P1. Thus, the internal current generator 1 is a current mirror circuit formed with the transistors P1 and P2: the internal current generator 1 generates an output current i2 according to an input current i1 flowing at the input node of the internal current generator 1 (the collector of the transistor P1), and feeds the output current i2 via the output node of the internal current generator 1 (the collector of the transistor P2) to the internal circuit of the semiconductor device so that the output current i2 is used as an internal current within the semiconductor device.

The external terminal 2 is a terminal via which an external resistor Rex for setting the internal current is connected to the input node side of the internal current generator 1. Outside the semiconductor device, one end of the external resistor Rex is connected to the external terminal 2, and the other end of the external resistor Rex is grounded. This configuration including the external terminal 2 permits the user of the semiconductor device to freely set the input current i1 (and hence the output current i2) within a predetermined variable range by appropriate selection of the external resistor Rex.

The current limiting element 3 is a direct-current impedance element (in this embodiment, a resistor RL1) connected between the input node of the internal current generator 1 and the external terminal 2. With this configuration, even if the external terminal 2 short-circuits to ground, or if the resistance of the external resistor Rex is set too low, the current limiting element 3 limits the input current i1 below or equal to a maximum level (and hence limits the output current i2 below or equal to a maximum level), allowing the internal circuit to operate steadily and thereby preventing system breakdown (see FIG. 2).

The first current limiting section 4 includes pnp-type bipolar transistors P3 and P4, npn-type bipolar transistors N1 to N4, constant current sources I1 and I2, a diode D1, and a resistor RL2. The emitters of the transistors N1 and N2 are connected together, and the node between them is grounded through the constant current source I1. The collector of the transistor N1 is connected to the collector of the transistor P4. The base of the transistor N1 is connected to a first end (point A) of the resistor RL1. The collector of the transistor N2 is connected to the power line L1. The base of the transistor N2 is connected to a first end (point B) of the resistor RL2, and is also grounded through the constant current source I2. A second end of the resistor RL2 is connected to the cathode of the diode D1. The anode of the diode D1 is connected to the power line L1. The emitters of the transistors P3 and P4 are both connected to the power line L1, and the bases of the transistors P3 and P4 are both connected to the collector of the transistor P4. The collector of the transistor P3 is connected to the collector of the transistor N3. The emitters of the transistors N3 and N4 are both grounded. The collector of the transistor N4 is connected to the first end (point A) of the resistor RL1. The bases of the transistors N3 and N4 are both connected to the collector of the transistor N3. The diode D1 is formed by the same process as the transistor P1 of the internal current generator 1. The resistor RL2 is formed by the same process as, and in addition to have an equal resistance to, the resistor RL1, which serves as the current limiting element 3.

Thus, the first current limiting section 4 includes: a threshold voltage generating circuit (the diode D1, the resistor RL2, and the constant current source I2) that generates a first threshold voltage VB (the voltage at point B); a differential amplifier circuit (the transistors N1 and N2 and the constant current source I1) that receives, as differential inputs to it, the voltage VA at the first end of the resistor RL1 (the voltage at point A) and the first threshold voltage VB; and a first current mirror circuit (the transistors P3 and P4 and the transistors N3 and N4) that, according to the output current of the differential amplifier circuit that flows at the input node of the first current mirror circuit, derives the input current i1 from the first end (point A) of the resistor RL1. Exploiting the fact that the voltage drop across the resistor RL1 varies as the input current i1 varies, the first current limiting section 4 limits the input current i1 above or equal to a minimum level.

More specifically, the first current limiting section 4 operates as follows: if the external terminal 2 is left open, or if the resistance of the external resistor Rex is set too high, and as a result the voltage drop across the resistor RL1 is so low that the voltage VA at the first end of the resistor RL1 is higher than the first threshold voltage VB, then the first current limiting section 4 makes the above-mentioned differential amplifier circuit operate so that it derives the input current i1 in a predetermined ratio from the first end (point A) of the resistor RL1 such that the differential input voltages VA and VB to the differential amplifier circuit become equal. For example, in a case where the ratio between the currents that flow through the constant current sources I1 and I2 respectively is set at 2:1, the level of the input current i1 derived by the first current limiting section 4 is equal to that of the constant current that flows through the constant current source I2.

Figure 2:
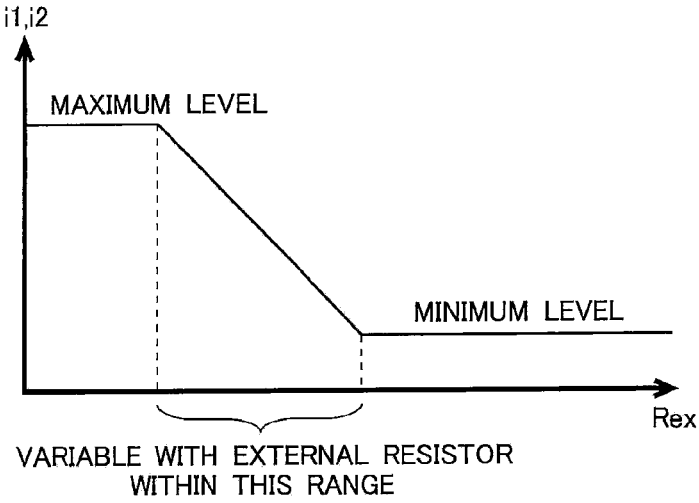
[FIG. 2] A diagram showing the relationship between the resistance of the external resistor Rex and the currents i1 and i2.

With this configuration, even if the external terminal 2 is left open, or if the resistance of the external resistor Rex is set too high, the first current limiting section 4 limits the input current i1 above or equal to a minimum level (and hence limits the output current i2 above or equal to a minimum level, allowing the internal circuit to operate steadily and thereby preventing system breakdown (see FIG. 2).

The second current limiting section 5 includes npn-type bipolar transistors N5 and N6, a resistor RL3, and diodes D2 and D3. The emitters of the transistors N5 and N6 are both grounded. The bases of the transistors N5 and N6 are both connected to the collector of the transistor N6. The collector of the transistor N5 is connected to the first end (point A) of the resistor RL1. The collector of the transistor N6 is connected to the cathode of the diode D3, The anode of the diode D3 is connected to the cathode of the diode D2, and the anode of the diode D2 is connected through the resistor RL3 to the external terminal 2.

In other words, the second current limiting section 5 includes: a second current mirror circuit (the transistors N5 and N6) that, according to the current flowing at the input node thereof, derives the input current i1 from the first end (point A) of the resistor RL1; and a switch circuit (the diodes D2 and D3 and the resistor RL3) that is connected between the external terminal 2 and the input node of the second current mirror circuit (the collector of the transistor N6) and that conducts when the terminal voltage VC at the external terminal 2 (the voltage at point C) is higher than a second threshold voltage (the sum of the collector-emitter voltage drop of the transistor N6, the forward voltage drops across the diodes D2 and D3, and the voltage drop across the resistor RL3).

With this configuration, even if the external terminal 2 is short-circuited to the supply voltage, the second current limiting section 5 permits the input current i1 to flow, and in addition the direct-current impedance component (the resistor RL3 and the diodes D2 and D3) of the second current limiting section 5 and the current limiting element 3 (the resistor RL1) limit the input current i1 below or equal to a maximum level (and hence limits the output current i2 below or equal to a maximum level, allowing the internal circuit to operate steadily and thereby preventing system breakdown (see FIG. 2).

Although the embodiment being described deals with, as an example, a case where two diodes D2 and D3 are inserted as a switch circuit for setting the driving threshold voltage of the second current limiting section 5, this is in no way meant to limit the configuration of the invention; instead, any other appropriate number of diodes may be inserted so long as an input current i1 can be derived that is large enough to make the internal circuit operate steadily.

The bias section 6 serves as means for applying a predetermined bias voltage to the external terminal 2. In this embodiment, the bias section 6 is formed with an npn-type bipolar transistor N7 whose collector is connected to the first end (point A) of the resistor RL1 and whose emitter is connected to the external terminal 2. The base voltage Vbias of the transistor N7 may be derived as a division voltage obtained simply by dividing a reference voltage with resistors, or as a voltage with higher voltage accuracy as obtained by buffering such a division voltage; alternatively, the base voltage Vbias may be controlled with high accuracy by feeding back the terminal voltage at the external terminal 2. Anyway, with this configuration, where the terminal voltage at the external terminal 2 is previously determined with the bias section 6, the user of the semiconductor device can easily calculate the resistance of the external resistor Rex he should select on the basis of the simple equation "(Input Current i1)=(Terminal Voltage VC at External Terminal 2)/(Resistance of External Resistor Rex). This helps improve the usability of the semiconductor device.

As described above, with the semiconductor device of this embodiment, not only if the external terminal 2 is short-circuited to ground or if the resistance of the external resistor Rex is set too low, but also if the external terminal 2 is left open, or if the resistance of the external resistor Rex is set too high, or if the external terminal 2 is short-circuited to a supply voltage, it is possible to continue supplying the internal current i2 within a predetermined range. Thus, with the semiconductor device of this embodiment, it is possible, irrespective of the state of the external terminal 2, to make the internal circuit operate steadily and thereby prevent system breakdown.

For example, when the present invention is applied to a semiconductor device in which the oscillation frequency of an internal oscillation circuit is determined by the output current i2, even if a fault such as short-circuiting of the external terminal 2 occurs, it is possible to make the internal oscillation circuit operate steadily and thereby prevent the breakdown of the system that exploits its oscillation output. Needless to say, the above example of application is merely an example and is in no way meant to limit the application of the invention; the invention finds wide application in semiconductor devices in general that permit an internal current to be set freely by appropriate selection of an external resistor.

Incidentally, the maximum and minimum levels of the input current i1 (and hence the maximum and minimum levels of the output current i2) in case of a fault such as short-circuiting of the external terminal 2 are set to suit specific cases according to the specifications of the internal circuit by appropriately adjusting the relevant circuit constants (such as the resistances of the resistors RL1 to RL3).

The invention may be practiced otherwise than specifically described by way of an embodiment above, with any modification or variation made within the spirit of the invention.

For example, it is also possible to use, instead of the pnp-type bipolar transistors P1 to P4 above, P-channel field-effect transistors and, instead of the npn-type bipolar transistors N1 to N7 above, N-channel field-effect transistors.

Figure 3:
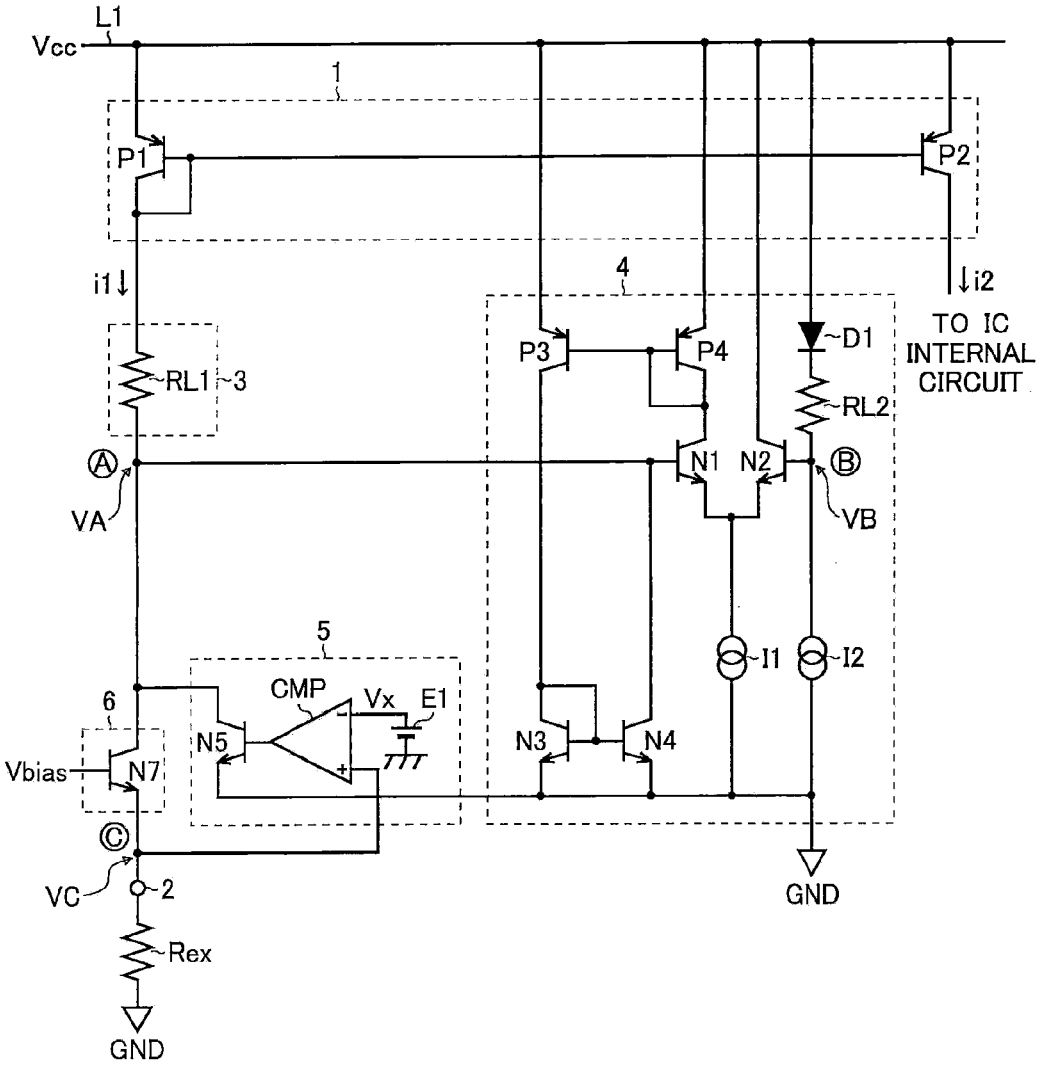
[FIG. 3] A diagram showing another example of the configuration of the second current limiting section 5.
Figure 4:
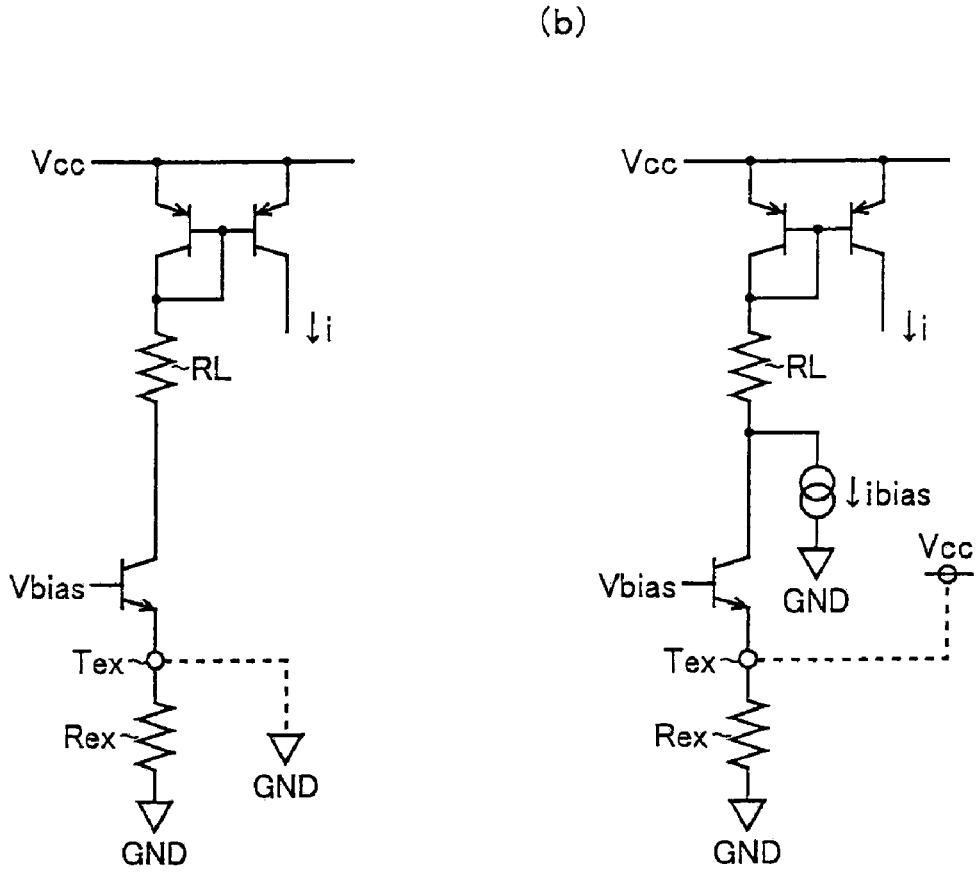
PRIOR ART FIG. 4
[FIG. 4] Diagrams showing examples of conventional semiconductor devices.

For example, the internal configuration of the second current limiting section 5 may be so modified as to include a comparator CMP as shown in FIG. 3. Specifically, in that case, the second current limiting section 5 includes: a direct-current voltage source E1 that generates a second threshold voltage Vx; a comparator CMP that shifts its output logic level according to the levels of the terminal voltage VC at the external terminal 2 and of the second threshold voltage Vx relative to each other; and a transistor N5 that derives the input current i1 from the first end of the current limiting element 3 when the terminal voltage VC at the external terminal 2 is higher than the second threshold voltage Vx according to the output signal of the comparator CMP.

With this configuration, the second threshold voltage Vx is generated by the direct-current voltage source E1 (e.g., a band-gap power supply circuit) whose characteristics do not depend on temperature. Thus, it is possible to avoid the influence of temperature-related characteristics of the relevant elements as experienced in the configuration using the diodes D2 and D3.

INDUSTRIAL APPLICABILITY

The present invention is useful in improving the reliability of semiconductor devices that permit an internal current to be set freely by appropriate selection of an external resistor.

The invention claimed is:

1. A semiconductor device comprising:

an internal current generating section to generate an output current according to an input current flowing at an input node thereof, and to feed the output current to an internal circuit;

an external terminal via which an external resistor for setting the internal current is connected to an input-node side of the internal current generating section;

a current limiting element that is connected between the input node of the internal current generating section and the external terminal;

a first current limiting section to derive the input current when a voltage at a first end of the current limiting element is higher than a first threshold voltage; and a second current limiting section to derive the input current when a terminal voltage at the external terminal is higher than a second threshold voltage, wherein the first current limiting section comprises:

a differential amplifier circuit to receive, as differential inputs thereto, the voltage at the first end of the current limiting element and the first threshold voltage; and a first current mirror circuit that, according to an output current of the differential amplifier circuit that flows at an input node of the first current mirror circuit, derives the input current from the first end of the current limiting element.

2. The semiconductor device according to claim 1, wherein the second current limiting section comprises:

a second current mirror circuit that, according to a current that flows at an input node thereof, derives the input current from the first end of the current limiting element; and a switch circuit that is connected between the external terminal and the input node of the second current mirror circuit and that conducts when the terminal voltage at the external terminal is higher than a second threshold voltage.

3. The semiconductor device according to claim 2, wherein the switch circuit comprises:

a resistor of which one end is connected to the external terminal; and a diode or diode array of which an anode end is connected to the resistor and of which a cathode end is connected to the input node of the second current mirror circuit.

4. The semiconductor device according to claim 1, wherein the second current limiting section comprises:

a direct-current voltage source that generates the second threshold voltage;

a comparator that shifts an output logic level thereof according to levels of the terminal voltage at the external terminal and the second threshold voltage relative to each other; and a transistor that derives the input current from the first end of the current limiting element when the terminal voltage at the external terminal is higher than the second threshold voltage according to an output signal of the comparator.

5. The semiconductor device according to claim 1, further comprising:

a bias section that applies a predetermined bias voltage to the external terminal.

6. The semiconductor device according to claim 5, wherein the bias section is formed with an npn-type bipolar transistor whose collector is connected to the first end of the current limiting element and whose emitter is connected to the external terminal.

7. The semiconductor device according to claim 1, wherein the current limiting element is a direct-current impedance element.

8. The semiconductor device according to claim 1, wherein the internal current generator is a current mirror circuit formed with a pair of transistors.

9. A semiconductor device comprising:

an internal current generating section to generate an output current according to an input current flowing at an input node thereof, and to feed the output current to an internal circuit;

an external terminal via which an external resistor for setting the internal current is connected to an input-node side of the internal current generating section;

a current limiting element that is connected between the input node of the internal current generating section and the external terminal;

a first current limiting section to derive the input current when a voltage at a first end of the current limiting element is higher than a first threshold voltage; and a second current limiting section to derive the input current when a terminal voltage at the external terminal is higher than a second threshold voltage, wherein the first current limiting section comprises:

a second current mirror circuit that, according to a current flowing at an input node of the second current mirror circuit, derives the input current from the first end of the current limiting element; and a switch circuit that is connected between the external terminal and the input node of the second current mirror circuit and that conducts when the terminal voltage at the external terminal is higher than the second threshold voltage.

10. The semiconductor device according to claim 9, wherein the switch circuit comprises:

a resistor having an end connected to the external terminal; and a diode or diode array having an anode end connected to the resistor and a cathode end connected to the input node of the second current mirror circuit.

11. The semiconductor device according to claim 9, further comprising:

a bias section to apply a predetermined bias voltage to the external terminal.

12. The semiconductor device according to claim 11, wherein the bias section includes an npn-type bipolar transistor whose collector is connected to the first end of the current limiting element and whose emitter is connected to the external terminal.

13. The semiconductor device according to claim 9 wherein the current limiting element is a direct-current impedance element.

14. The semiconductor device according to claim 9 wherein the internal current generating section is a current mirror circuit comprising a pair of transistors.

15. A semiconductor device comprising:

an internal current generating section to generate an output current according to an input current flowing at an input node thereof, and to feed the output current to an internal circuit;

an external terminal via which an external resistor for setting the internal current is connected to an input-node side of the internal current generating section;

a current limiting element that is connected between the input node of the internal current generating section and the external terminal;

a bias section to apply a predetermined bias voltage to the external terminal; and one of a first current limiting section to derive the input current when a voltage at a first end of the current limiting element is higher than a first threshold voltage; or a second current limiting section to derive the input current when a terminal voltage at the external terminal is higher than a second threshold voltage, wherein the bias section includes an npn-type bipolar transistor whose collector is connected to the first end of the current limiting element and whose emitter is connected to the external terminal.

16. The semiconductor device according to claim 15, wherein the current limiting element is a direct-current impedance element.

17. The semiconductor device according to claim 15, wherein the internal current generating section is a current mirror circuit that includes a pair of transistors.

18. A semiconductor device comprising:

an internal current generating section to generate an output current according to an input current flowing at an input node thereof, and to feed the output current to an internal circuit;

an external terminal via which an external resistor for setting the internal current is connected to an input-node side of the internal current generating section;

a current limiting element that is connected between the input node of the internal current generating section and the external terminal;

a bias section to apply a predetermined bias voltage to the external terminal; and a first current limiting section to derive the input current when a voltage at a first end of the current limiting element is higher than a first threshold voltage; and a second current limiting section to derive the input current when a terminal voltage at the external terminal is higher than a second threshold voltage, wherein the bias section includes an npn-type bipolar transistor whose collector is connected to the first end of the current limiting element and whose emitter is connected to the external terminal; and wherein the second current limiting section comprises:

a second current mirror circuit that, according to a current flowing at an input node thereof, derives the input current from the first end of the current limiting element; and a switch circuit that is connected between the external terminal and the input node of the second current mirror circuit and that conducts when the terminal voltage at the external terminal is higher than a second threshold voltage, wherein the switch circuit comprises:

a resistor having an end connected to the external terminal; and a diode or diode array having an anode end connected to the resistor and a cathode end connected to the input node of the second current mirror circuit.

19. A semiconductor device comprising:

an internal current generating section to generate an output current according to an input current flowing at an input node thereof, and to feed the output current to an internal circuit;

an external terminal via which an external resistor for setting the internal current is connected to an input-node side of the internal current generating section;

a current limiting element that is connected between the input node of the internal current generating section and the external terminal;

a bias section to apply a predetermined bias voltage to the external terminal; and a first current limiting section to derive the input current when a voltage at a first end of the current limiting element is higher than a first threshold voltage; and a second current limiting section to derive the input current when a terminal voltage at the external terminal is higher than a second threshold voltage, wherein the bias section includes an npn-type bipolar transistor whose collector is connected to the first end of the current limiting element and whose emitter is connected to the external terminal; and wherein the second current limiting section comprises:

a direct-current voltage source to generate a second threshold voltage;

a comparator to shift an output logic level thereof according to relative levels of the terminal voltage at the external terminal and the second threshold voltage; and a transistor to derive the input current from the first end of the current limiting element when the terminal voltage at the external terminal is higher than the second threshold voltage according to an output signal of the comparator.

* * * * *